US006430824B1

(12) United States Patent
Smith

(10) Patent No.: US 6,430,824 B1
(45) Date of Patent: Aug. 13, 2002

(54) SCREED SYSTEM FOR WALLS

(76) Inventor: Christopher W. Smith, 11981 Ashley Pl., San Diego, CA (US) 92128

( * ) Notice: Subject to any disclaimer, the term of this patent is extended or adjusted under 35 U.S.C. 154(b) by 13 days.

(21) Appl. No.: 09/697,985

(22) Filed: Oct. 26, 2000

(51) Int. Cl.[7] ..... G01C 15/00; G01C 9/00
(52) U.S. Cl. ..... 33/286; 33/370; 33/365
(58) Field of Search ..... 33/DIG. 21, 370, 33/371, 384, 385, 286, 381, 347, 404, 227, 228, 613

(56) References Cited

U.S. PATENT DOCUMENTS

| | | | | | |
|---|---|---|---|---|---|
| 685,455 | A | * | 10/1901 | Kinkead | 33/286 |
| 2,314,927 | A | * | 3/1943 | Farrington | 33/370 |
| 2,546,524 | A | * | 3/1951 | Schipplock | 33/286 |
| 3,296,708 | A | * | 1/1967 | Moody | 33/371 |
| 3,590,445 | A | | 7/1971 | Braun | |
| 3,982,839 | A | * | 9/1976 | Schwartz | 33/DIG. 21 |
| 4,128,982 | A | | 12/1978 | Weaver | |
| D348,619 | S | | 7/1994 | Hansen | |
| 5,387,051 | A | | 2/1995 | Valente | |
| 5,392,523 | A | | 2/1995 | Hurt | |
| 5,713,135 | A | | 2/1998 | Acopulos | |
| 6,279,239 | B1 | * | 8/2001 | Astudillo | 33/286 |
| 6,279,282 | B1 | * | 8/2001 | Krionidis | 52/365 |

* cited by examiner

*Primary Examiner*—Diego Gutierrez
*Assistant Examiner*—Mirellys Jagan

(57) ABSTRACT

A screed system for walls for allowing the user to work faster and more efficiently and to effectively plaster a wall to a uniform thickness. The screed system for walls includes a mounting bracket being adapted to removably mount to a wall; and also includes a leveling assembly being movably mounted to the mounting bracket and including a leveling tool; and further includes a squaring level assembly being adapted to be mounted in a corner of two adjoining walls; and also includes ia plurality of screed support members being adapted to be fastened to and extended outwardly from studs supporting the wall; and further includes screed members being securely mounted to the screed support members for determining a depth of plaster and mortar being applied to the wall.

16 Claims, 10 Drawing Sheets

FIG. 3
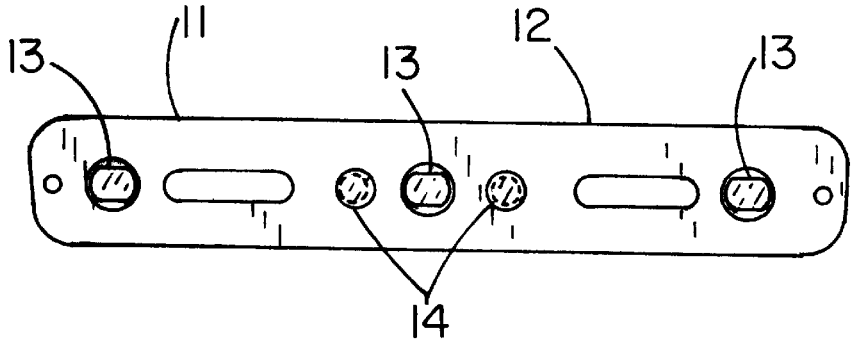
FIG. 4
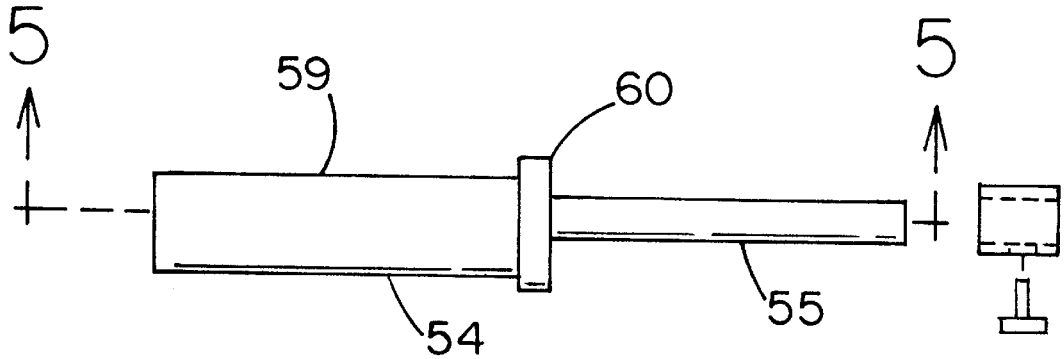
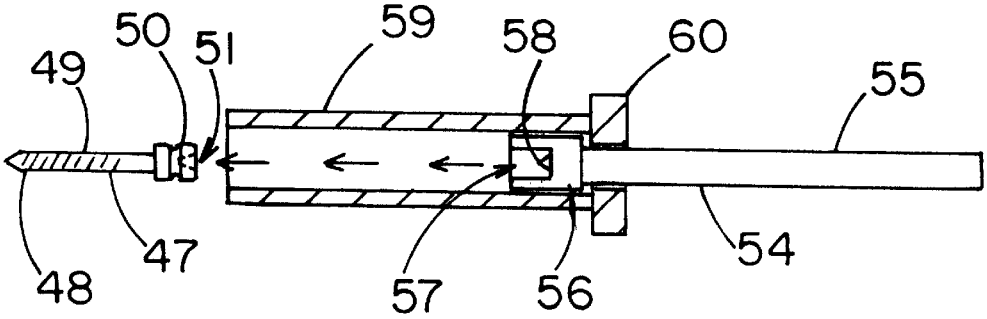
FIG. 5

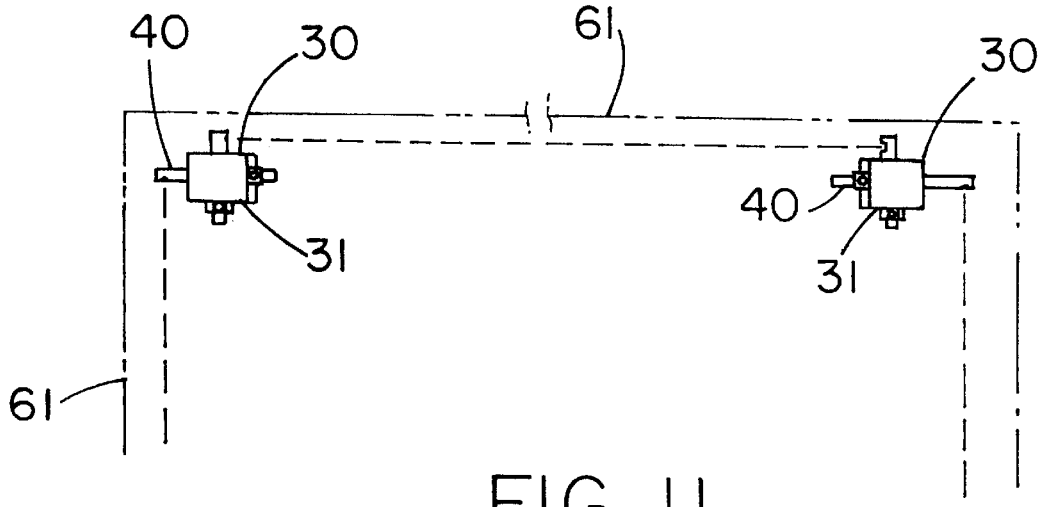
FIG. 11
FIG. 12
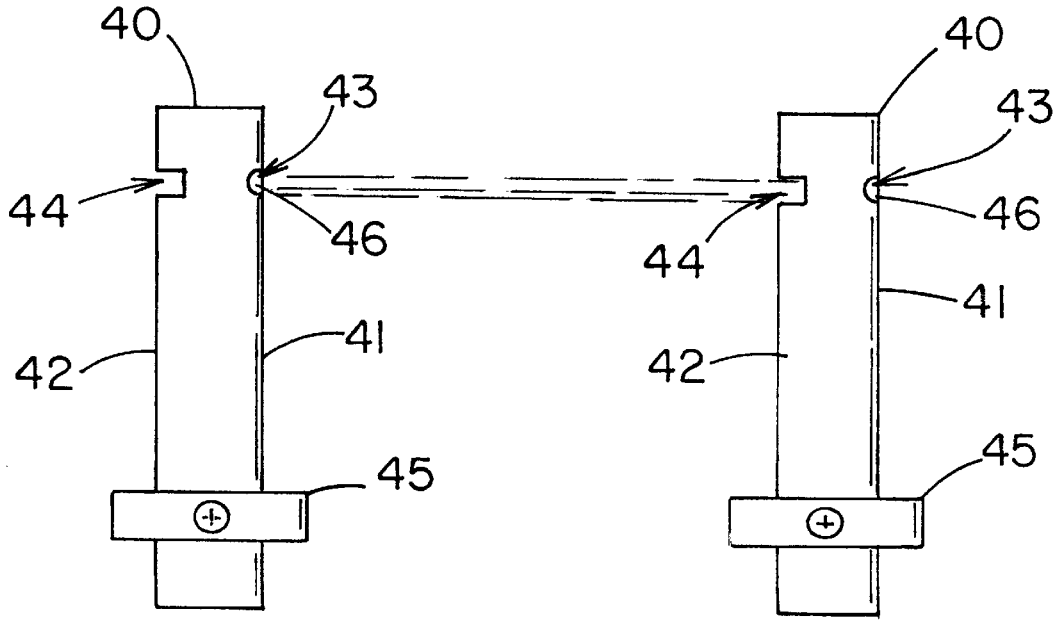

SCREED SYSTEM FOR WALLS

BACKGROUND OF THE INVENTION

1. Field of the Invention

The present invention relates to a speed screed system and more particularly pertains to a new screed system for walls for allowing the user to work faster and more efficiently and to effectively plaster a wall to a uniform thickness.

2. Description of the Prior Art

The use of a speed screed system is known in the prior art. More specifically, a speed screed system heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. No. 5,392,523; U.S. Pat. No. 5,713,135; U.S. Pat. No. 5,387,051; U.S. Pat. No. 4,128,982; U.S. Pat. No. 3,590,445; and U.S. Pat. No. Des. 348,619.

While these devices fulfill their respective, particular objectives and requirements, the aforementioned patents do not disclose a new screed system for walls. The inventive device includes a mounting bracket being adapted to removably mount to a wall; and also includes a leveling assembly being movably mounted to the mounting bracket and including a leveling tool; and further includes a squaring level assembly being adapted to be mounted in a corner of two adjoining walls; and also includes a plurality of screed support members being adapted to be fastened to and extended outwardly from studs supporting the wall; and further includes screed members being securely mounted to the screed support members for determining a depth of plaster and mortar being applied to the wall.

In these respects, the screed system for walls according to the present invention substantially departs from the conventional concepts and designs of the prior art, and in so doing provides an apparatus primarily developed for the purpose of allowing the user to work faster and more efficiently and to effectively plaster a wall to a uniform thickness.

SUMMARY OF THE INVENTION

In view of the foregoing disadvantages inherent in the known types of speed screed system now present in the prior art, the present invention provides a new screed system for walls construction wherein the same can be utilized for allowing the user to work faster and more efficiently and to effectively plaster a wall to a uniform thickness.

The general purpose of the present invention, which will be described subsequently in greater detail, is to provide a new screed system for walls which has many of the advantages of the speed screed system mentioned heretofore and many novel features that result in a new screed system for walls which is not anticipated, rendered obvious, suggested, or even implied by any of the prior art speed screed system, either alone or in any combination thereof.

To attain this, the present invention generally comprises a mounting bracket being adapted to removably mount to a wall; and also includes a leveling assembly being movably mounted to the mounting bracket and including a leveling tool; and further includes a squaring level assembly being adapted to be mounted in a corner of two adjoining walls; and also includes a plurality of screed support members being adapted to be fastened to and extended outwardly from studs supporting the wall; and further includes screed members being securely mounted to the screed support members for determining a depth of plaster and mortar being applied to the wall.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new screed system for walls which has many of the advantages of the speed screed system mentioned heretofore and many novel features that result in a new screed system for walls which is not anticipated, rendered obvious, suggested, or even implied by any of the prior art speed screed system, either alone or in any combination thereof.

It is another object of the present invention to provide a new screed system for walls which may be easily and efficiently manufactured and marketed.

It is a further object of the present invention to provide a new screed system for walls which is of a durable and reliable construction.

An even further object of the present invention is to provide a new screed system for walls which is susceptible of a low cost of manufacture with regard to both materials and labor, and which accordingly is then susceptible of low prices of sale to the consuming public, thereby making such screed system for walls economically available to the buying public.

Still yet another object of the present invention is to provide a new screed system for walls which provides in the apparatuses and methods of the prior art some of the advantages thereof, while simultaneously overcoming some of the disadvantages normally associated therewith.

Still another object of the present invention is to provide a new screed system for walls for allowing the user to work faster and more efficiently and to effectively plaster a wall to a uniform thickness.

Yet another object of the present invention is to provide a new screed system for walls which includes a mounting bracket being adapted to removably mount to a wall; and also includes a leveling assembly being movably mounted to the mounting bracket and including a leveling tool; and further includes a squaring level assembly being adapted to be mounted in a corner of two adjoining walls; and also includes a plurality of screed support members being adapted to be fastened to and extended outwardly from studs supporting the wall; and further includes screed members being securely mounted to the screed support members for determining a depth of plaster and mortar being applied to the wall.

Still yet another object of the present invention is to provide a new screed system for walls that is more accurate than any of the conventional ways of plastering a wall.

Even still another object of the present invention is to provide a new screed system for walls that allows the user to create perfectly flat, square, and straight walls.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 3 is a front elevational view of the leveling tool mounting bracket of the present invention.

FIG. 4 is a side elevational view of a screed screw holder of the present invention.

FIG. 5 is a cross-sectional view of the screed screw holder of the present invention.

FIG. 11 is a front elevational view of the use of the laser assembly of the present invention.

FIG. 12 is a detailed side elevational view of the lazer members of the present invention.

DESCRIPTION OF THE PREFERRED EMBODIMENT

Figure 1:
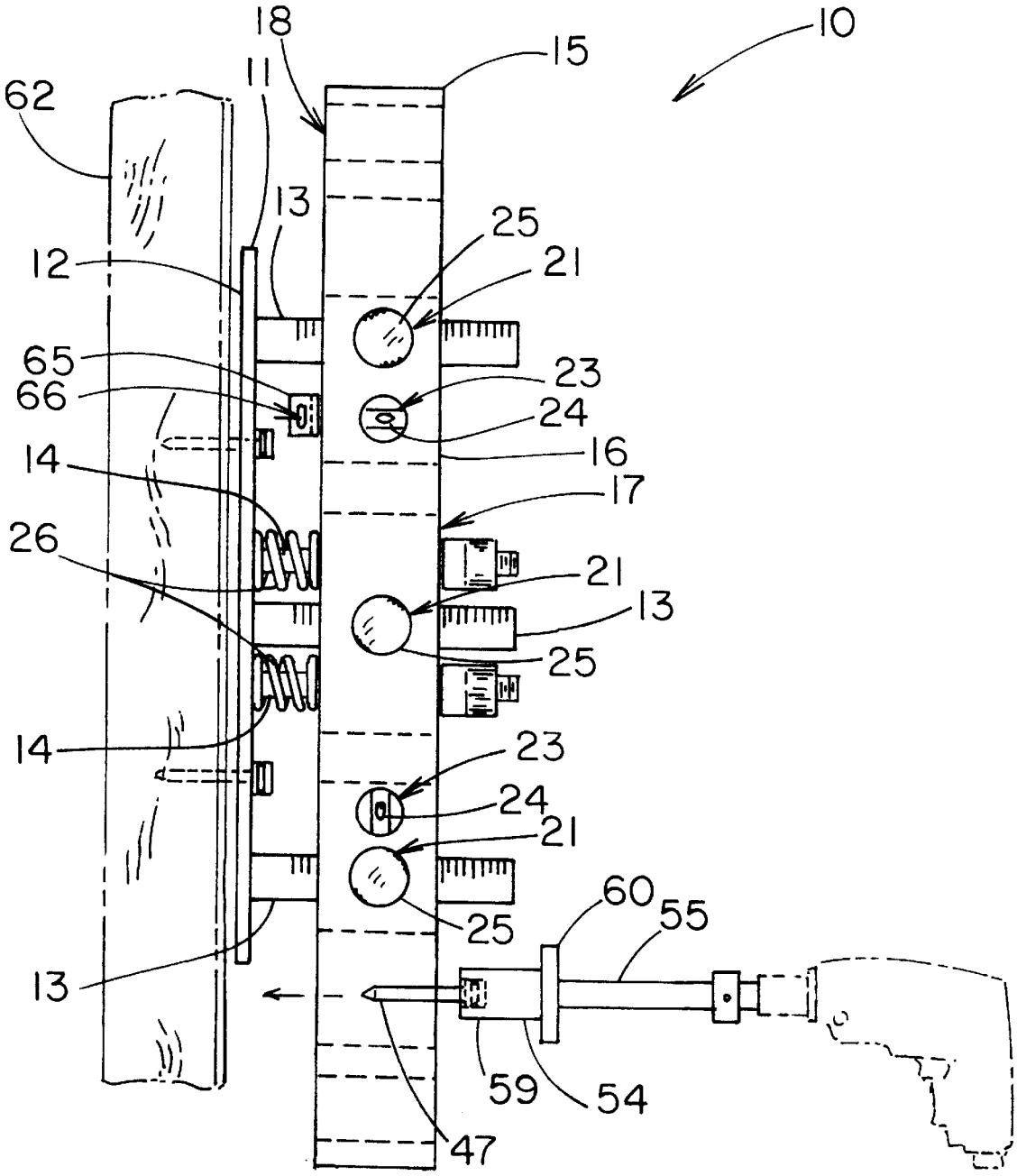
FIG. 1 is a side elevational view of a first embodiment of a new screed system for walls according to the present invention.
Figure 2:
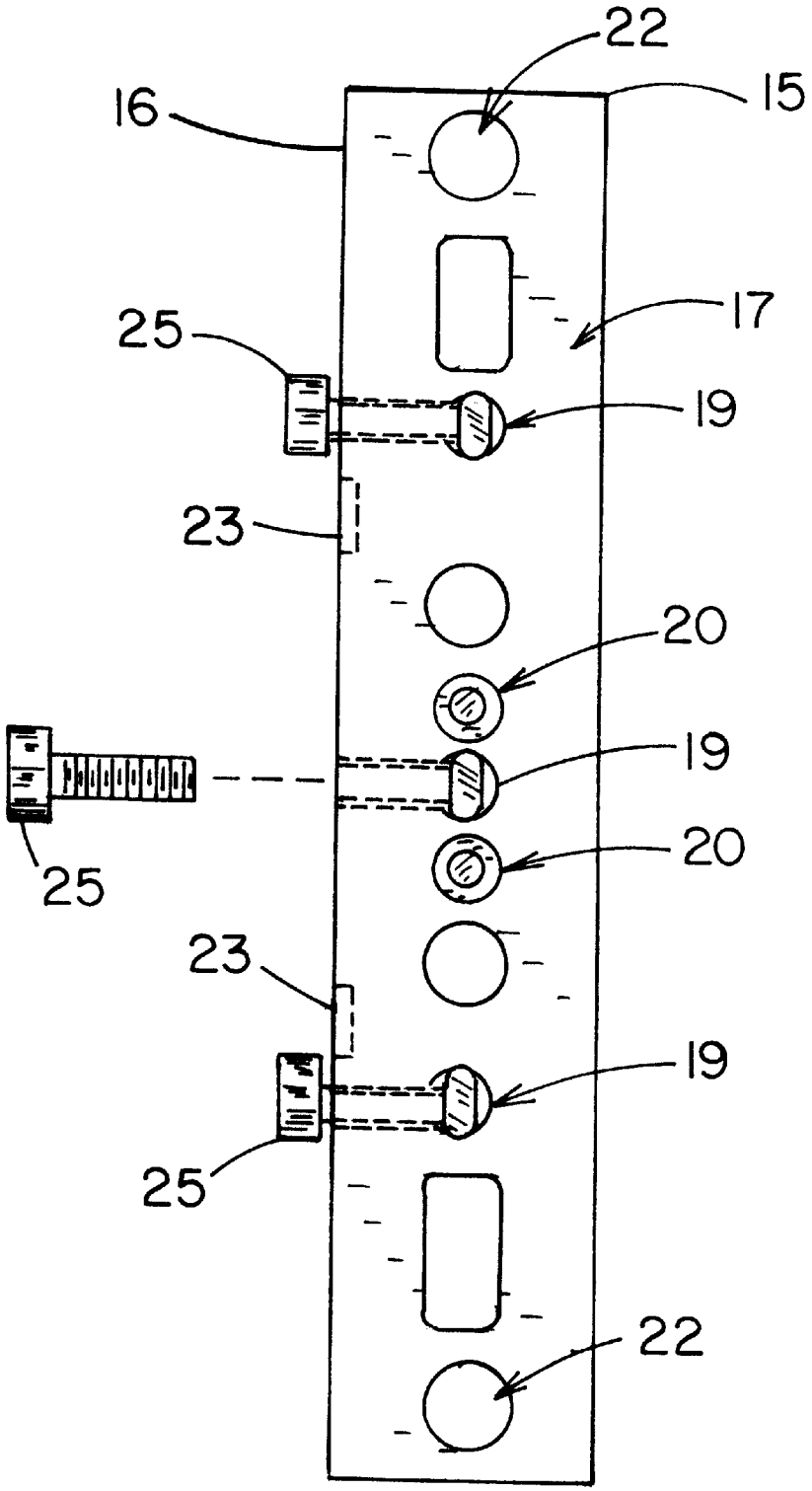
FIG. 2 is a front elevational view of the leveling tool of the present invention.
Figure 6:
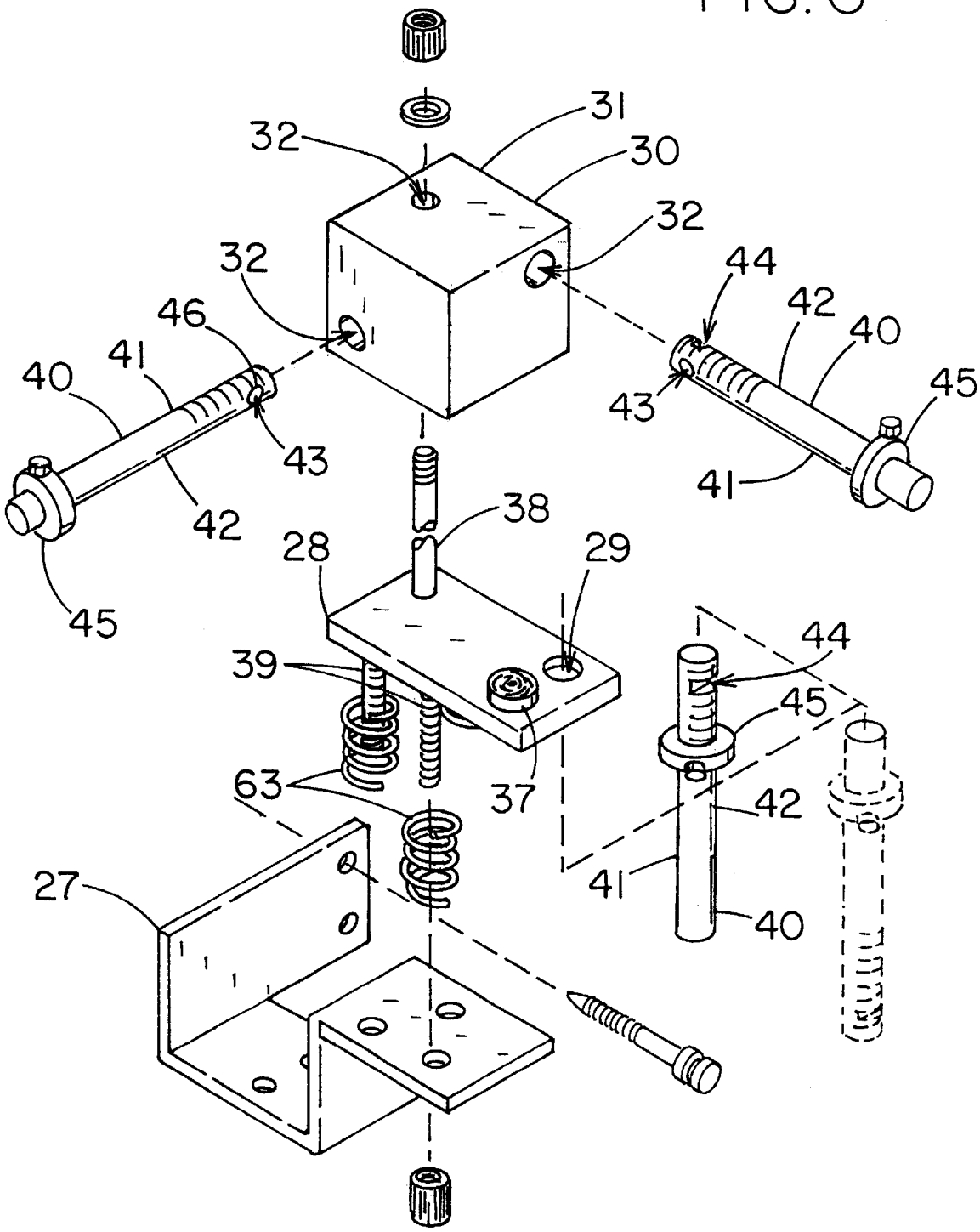
FIG. 6 is an exploded perspective view of the lazer assembly of the second embodiment of the present invention.
Figure 7:
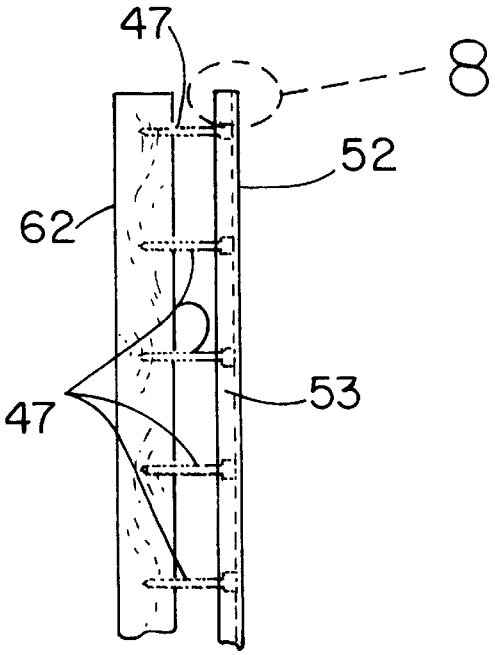
FIG. 7 is a side elevational view of a screed member attached to a wall structure.
Figure 8:
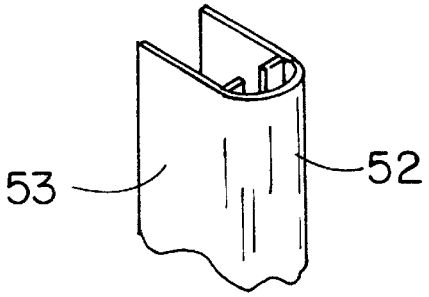
FIG. 8 is a perspective view of a first embodiment of the screed member of the present invention.
Figure 9:
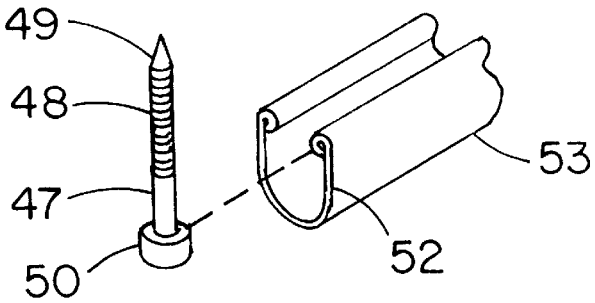
FIG. 9 is a perspective view of a second embodiment of the screed member and the screed screw of the present invention.
Figure 10:
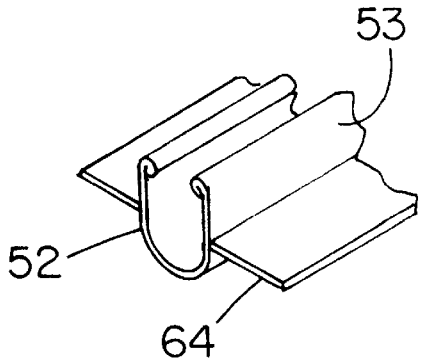
FIG. 10 is a perspective view of a third embodiment of the screed member of the present invention.
Figure 13:
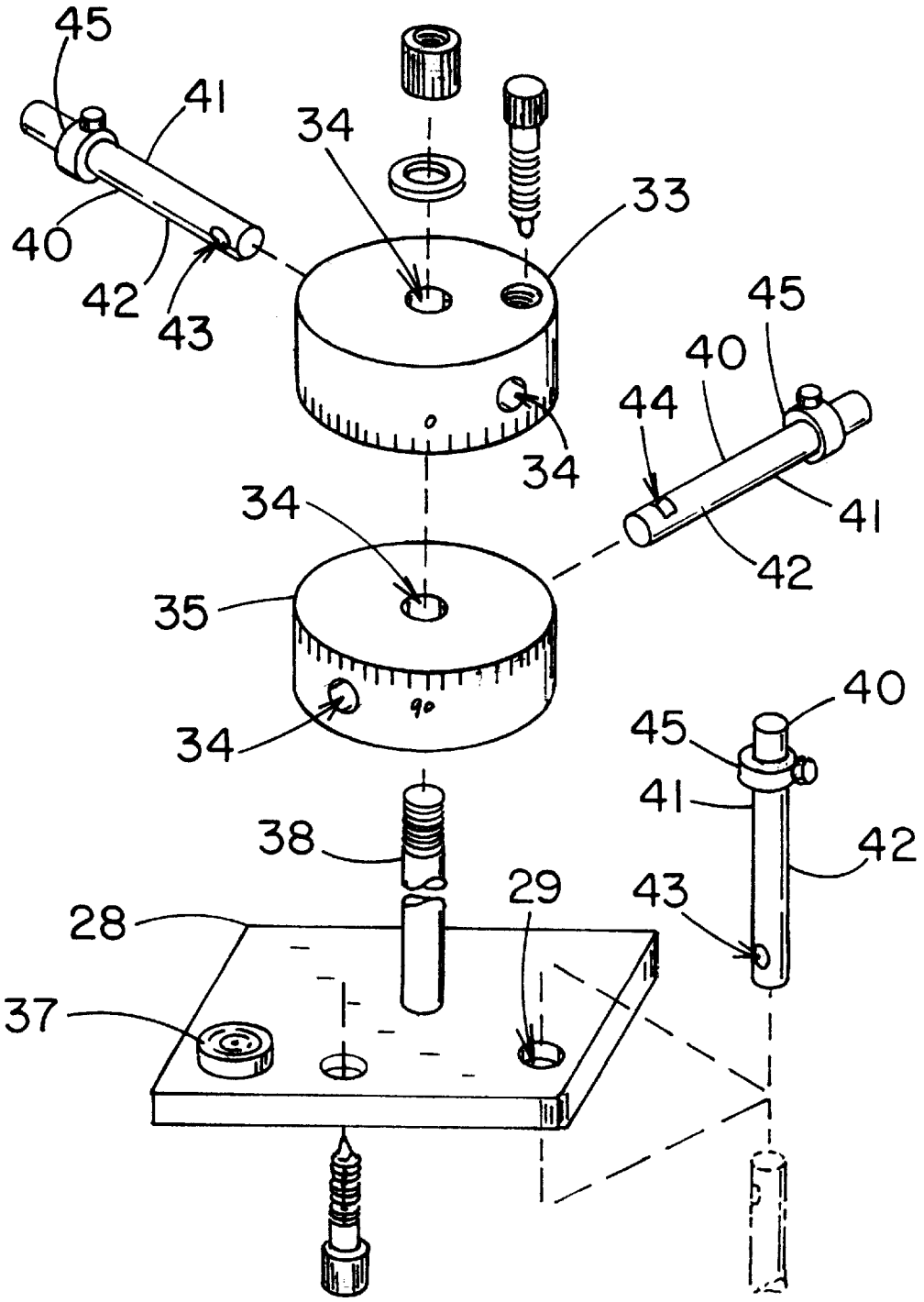
FIG. 13 is an exploded perspective view of a second embodiment of the laser assembly of the present invention.
Figure 14:
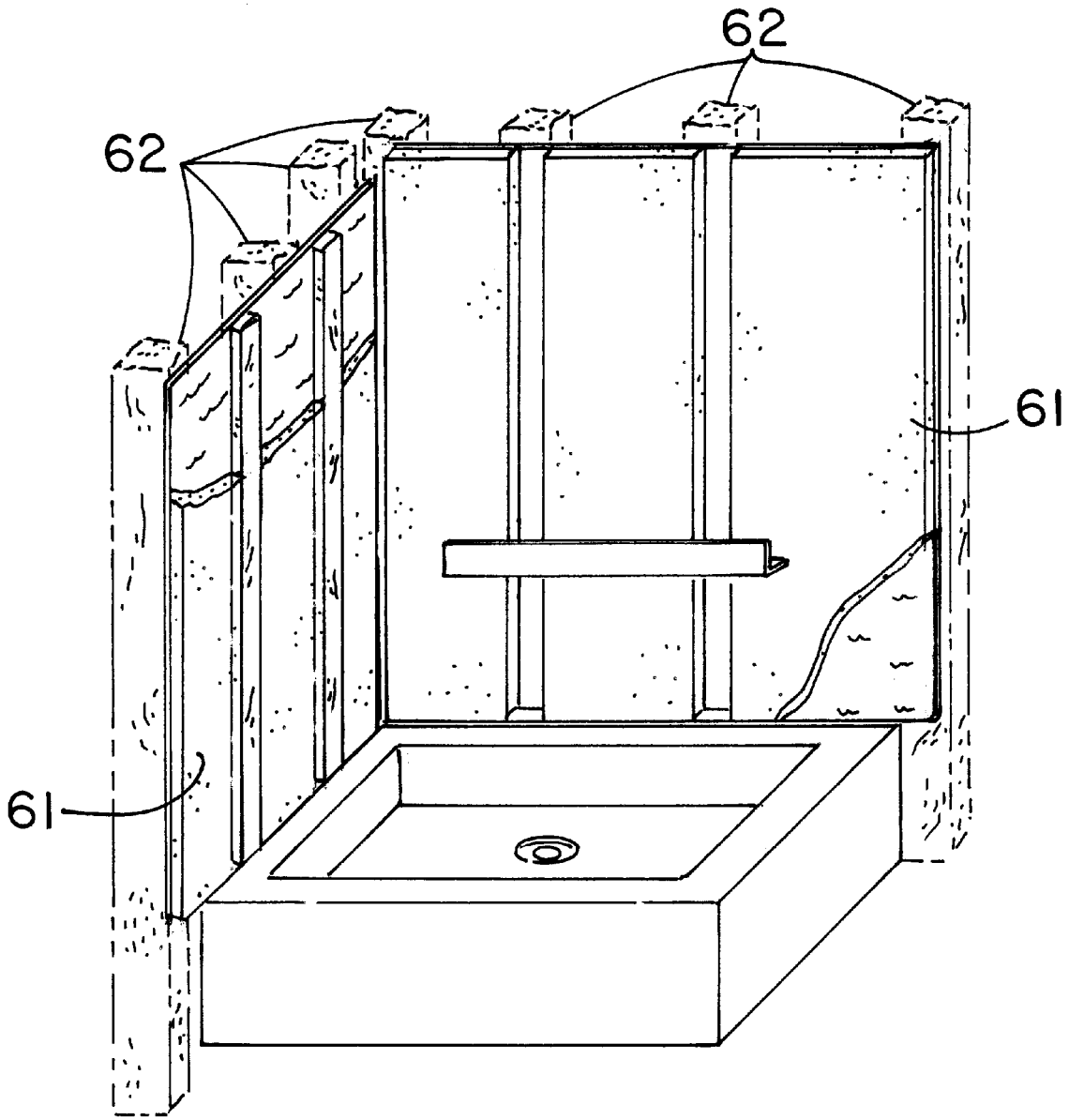
PRIOR ART FIG. 14
FIG. 14 is a perspective view of the old art used to level walls.
Figure 15:
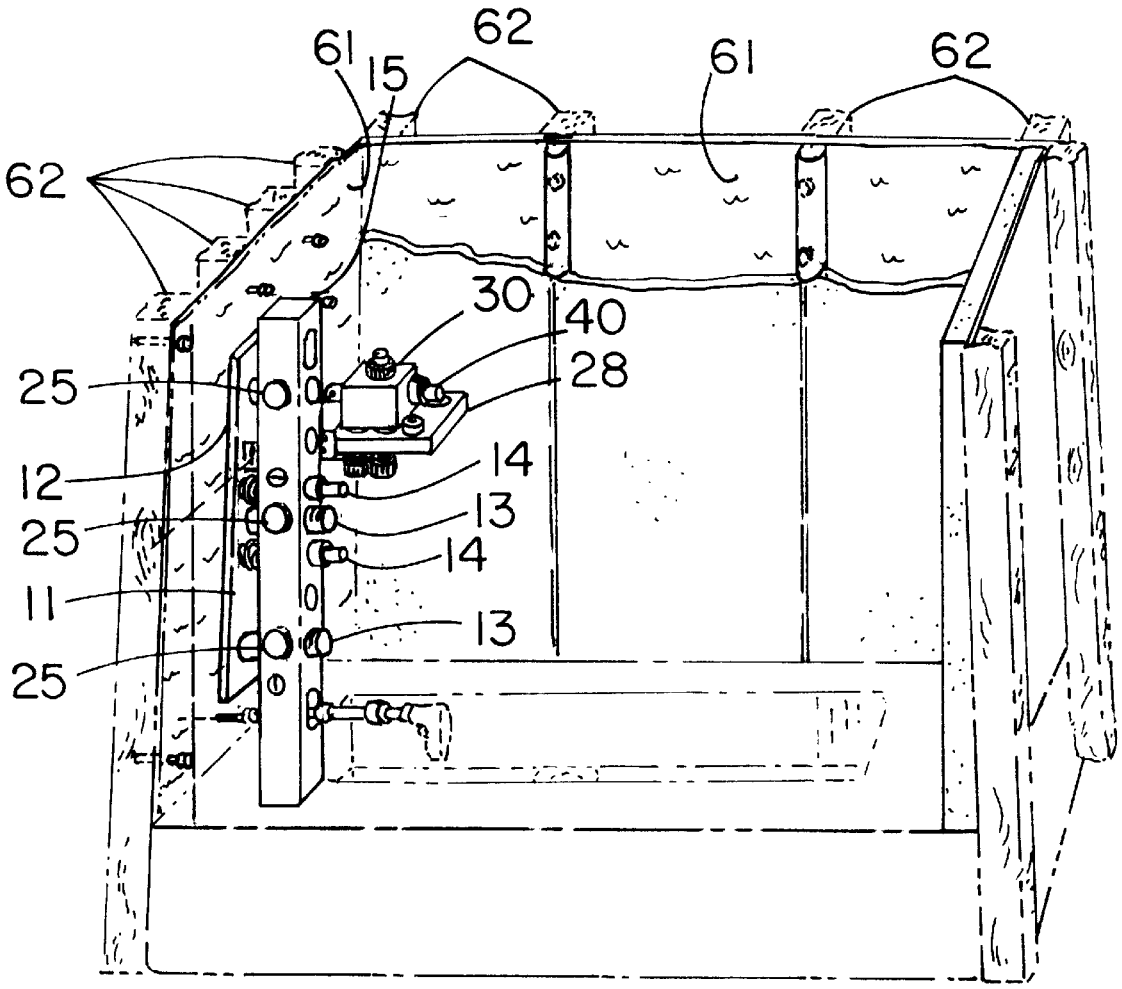
FIG. 15 is a perspective view of the present invention shown in use.
Figure 16:
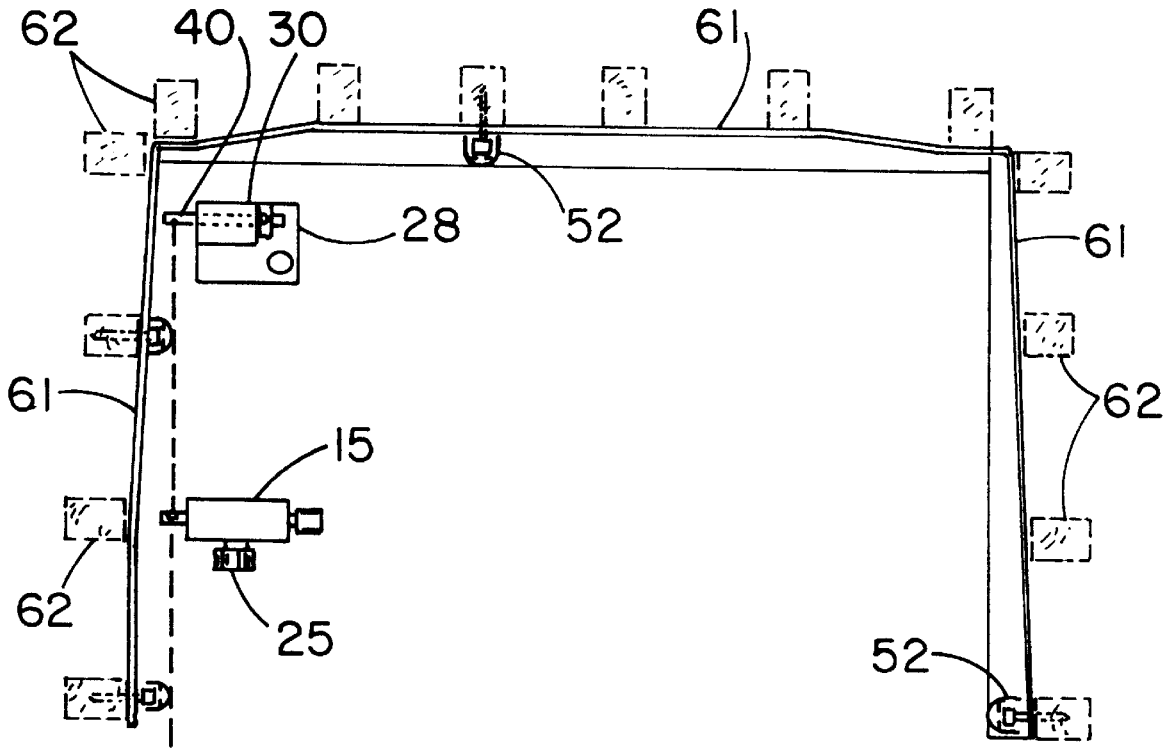
FIG. 16 is a top plan view of the present invention shown in use.

With reference now to the drawings, and in particular to FIGS. 1 through 16 thereof, a new screed system for walls embodying the principles and concepts of the present invention and generally designated by the reference numeral 10 will be described.

As best illustrated in FIGS. 1 through 16, the screed system for walls 10 generally comprises a mounting bracket 11 being adapted to removably and conventionally mount to a wall 61. The mounting bracket 11 includes a plate-like member 12 being adapted to be fastened with mounting fasteners to the stud 62 in the wall 61, and also includes leveling tool support members 13 being spaced apart and being securely and conventionally attached to and extending outwardly from the plate-like member 12, and further includes spring support members 14 being securely and conventionally attached to and extending outwardly from the plate-like member 12.

A leveling assembly is movably mounted to the mounting bracket 11 and includes a leveling tool 15. The leveling tool 15 includes an elongate member 16 having a definite thickness and also having a front 17 and a back 18 and further having a plurality of bores 19–22 extending through the elongate member 16. The bores 19–22 include first bores 19 which are spaced apart and which extend from the front 17 through the back 18 of the elongate member 16 and which are adapted to receive the leveling tool support members 13 therethrough. The bores 19–22 also include second bores 20 which extend through the elongate member 16 from the front 17 through the back 18 of the elongate member 16 and which are adapted to receive the spring support members 14 therethrough. The bores 19–22 further include third bores 21 which extend through a side of the elongate member 16 into the first bores 19. The bores 19–22 also include fourth bores 22 which extend through the elongate member 16 from the front 17 through the back 18. The elongate member 16 also includes slots 23 being spaced apart and being disposed in the side of the elongate member 16. The leveling assembly further includes tubular members 24 being securely and conventionally disposed in the slots 23. Each of the tubular members 24 include liquid and a bubble for leveling purposes. The leveling assembly also includes elongate threaded fasteners 25 being threaded into the third bores 21 and being engagable to the leveling tool support members 13, and further includes springs 26 being mounted about the spring support members 14 and being biasedly disposed between the elongate member 16 and the plate-like member 12. The spring support members 14 are adjustably fastened to the elongate member 16 with fastening members. The leveling assembly further includes a sight member 65 being securely and conventionally attached to the elongate member 16 and being disposed between the elongate member 16 and said plate-like member 12 of said mounting bracket 11. The sight member 65 has a hole 66 extending therethrough.

The squaring level assembly includes a laser assembly having a bracket member 27 being adapted to be mounted in corners of two adjoining walls 61, and also having a plate-like leveling member 28 being adjustably and conventionally mounted upon the bracket member 27 and having a hole 29 disposed therethrough, and further having a laser support assembly 30 being fastenably mounted upon the plate-like leveling member 28, and also having laser members 40 being removably disposed in the laser support assembly 30 and through the hole 29 of the plate-like leveling member 28, and further having elongate threaded members 38,39 being securely and conventionally attached to a top and a bottom of the plate-like leveling member 28, and also having fasteners being threaded upon the elongate threaded members 38,39, and further having spring members 63 mounted about the bottom elongate threaded members 39 and being biasedly disposed between the bracket member 27 and the plate-like leveling member 28, and also having a level gauge 37 being conventionally disposed upon the top of the plate-like leveling member 28. Each of the laser members 40 includes a cylindrical housing 41 having an opening 43 through a wall 42 thereof and also having a slot 44 diametrically opposed to the opening 43 and being disposed through the wall 42, and further includes a laser light-emitting member 46 being conventionally disposed in the cylindrical housing 41 and being adapted to shine a beam of light through the opening 43, and also includes an annular stop member 45 being fastenably and movably mounted about the cylindrical housing 41 to adjustably set the laser member 40 in the laser support assembly 30.

A plurality of screed support members 47 are adapted to be fastened to and extended outwardly from studs 62 supporting the wall 61. Each of the screed support members 47 includes a threaded shaft portion 48 having a pointed front end 49, and also includes a head portion 50 having a centrally-disposed recessed portion 51 in a back end thereof. The screed support members 47 are adapted to be threaded into the stud 62 of the wall 61 with a plane passing through the back ends of the screed support members 47.

Screed members 52 are securely and conventionally mounted to the screed support members 47 for determining a depth of plaster 64 to be applied to the wall 61. Each of the screed members 52 includes a strip of material 53 having a laterally-curved wall and being adapted to fit upon the head portions 50 of the screed support members 47. The screed members 52 are adapted to determine a depth of plaster 64 and mortar to be applied to the wall 62.

A tool attachment 54 for holding the screed support members 47 when the screed support members 47 are being threaded into the stud 62 of the wall 61 includes a shaft 55, a sleeve 59 securely and conventionally attached to the shaft 55 and being adapted to receive the screed support members 47 therein. The shaft 55 has an enlarged end portion 56 which is disposed in the sleeve 59. The enlarged end portion 56 has a slot 57 therein and a pointed node 58 conventionally disposed in the slot 57. The head portions 50 of the screed support members 47 are removably received in the slot 57. The sleeve 59 is removably received in the fourth bores 22 of the elongate member 16. The tool attachment 54 further includes an annular flange 60 being conventionally disposed about the sleeve 59 to limit extension of the sleeve 59 into the fourth bores 22. The annular flange 60 is contactable with the elongate member 16.

As a first embodiment, the laser support assembly 30 includes a block-like member 31 having a top, a bottom, and sides, and also having bores 32 extending through the top, the bottom, and the sides with the bores 32 being adapted to receive the laser members 40 and to receive the top elongate threaded member 38 of the plate-like leveling member 28.

As a second embodiment, the laser support assembly includes a pair of disc-shaped members 33,35 being rotatably mounted upon the plate-like leveling member 28 and being adjustable independently of one another. Each of the disc-shaped members 33,35 has a top, a bottom, and a side, and also has bores 34, extending through the top, the bottom and the side with the bores 34, being adapted to receive the laser members 40 and to receive the top elongate threaded member 38 of the plate-like leveling member 28. Each of the disc-shaped members 33,35 has degree markings displayed upon the wall thereof.

In use, the user will prepare the surface of the wall by applying waterproof paper along with a wire lathe. The user would then fasten the mounting bracket 11 to the stud 62 in the wall 61. The user then mounts the leveling tool 15 upon the mounting bracket 11, and then threads the screed support members 47 into the stud 62 through the fourth bores 22 using a drill. Once the screed support members 47 are extended from the wall 61 at a certain depth, the user then mounts the screed members 52 upon the screed support members 47. There should be two screed members 52 for every wall 61 being plastered and mortared. To make sure that adjoining walls are square, the user mounts the bracket member 27 of the laser assembly in the corner of two adjoining walls 61 and close to the vertical center thereof. The spring members 63 and the level gauge 37 allows the user to level the laser assembly. The laser members 40 allow the user to shine a beam of light in a plane along the walls 61 to set the depth at which the plaster 64 and mortar are applied to the walls 61. The leveling assembly is then mounted at the desired positions upon the wall 61 using the sight member 65 being securely attached to said elongate member 16. The user adjusts the squaring level assembly to shine a beam of light from one of the laser members 40 through the hole 66 in the sight member 65. The user then threads the screed support members 47 into the studs 62 of the wall 61 to the selected depth and then attached the screed members 52 to the screed support members 47.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A screed system for walls comprising:

a mounting bracket being adapted to removably mount to a stud in a wall;

a leveling assembly being movably mounted to said mounting bracket and including a leveling tool;

a squaring level assembly being adapted to be removably mounted in a corner formed by the wall and an adjoining wall;

a plurality of screed support members being adapted to be fastened to and extended outwardly from the stud supporting the wall; and screed members being securely mounted to said screed support members for determining a depth of plaster being applied to the wall.

2. A screed system for walls as described in claim 1, wherein said mounting bracket includes a plate-like member being adapted to be fastened to the stud in the wall, and also includes leveling tool support members being spaced apart and being attached to and extending outwardly from said mounting bracket, and further includes spring support members being attached to and extending outwardly from said mounting bracket.

3. A screed system for walls as described in claim 2, wherein said leveling tool includes an elongate member having a definite thickness and also having a front and a back and further having a plurality of bores extending through said elongate member, said bores including first bores which are spaced apart and which extend from said front through said back of said elongate member and which are adapted to receive said leveling tool support members therethrough, said bores also including second bores which extend through said elongate member from said front through said back of said elongate member and which are adapted to receive said spring support members therethrough, said bores further including third bores which extend through a side of said elongate member into said first bores, said bores also including fourth bores which extend through said elongate member from said front through said back.

4. A screed system for walls as described in claim 3, wherein said elongate member also includes slots being spaced apart and being disposed in said side of said elongate member.

5. A screed system for walls as described in claim 4, wherein said leveling tool further includes tubular members being securely disposed in said slots, each of said tubular members including liquid and a bubble for leveling purposes.

6. A screed system for walls as described in claim 4, wherein each of said screed members includes a strip of material having a laterally-curved wall and being adapted to fit upon said head portions of said screed support members, said screed members being adapted to determine a depth of plaster and mortar being applied to the wall.

7. A screed system for walls as described in claim 3, wherein said leveling assembly also includes elongate threaded fasteners being threaded into said third bores and being engagable to said leveling tool support members, and further includes springs being mounted about said spring support members and being biasedly disposed between said elongate member and said plate-like member, said spring support members being adjustably fastened to said elongate member with fastening members, said leveling assembly further including a sight member being attached to said elongate member and being disposed between said elongate member and said plate-like member of said mounting bracket, said sight member having a hole extending therethrough.

8. A screed system for walls as described in claim 3, wherein each of said screed support members includes a threaded shaft portion having a pointed front end, and also includes a head portion having a centrally-disposed recessed portion in a back end thereof, said screed support members being adapted to be threaded into the stud of the wall with a plane passing through said back ends of said screed support members.

9. A screed system for walls as described in claim 8 further includes a tool attachment for holding said screed support members when said screed support members are being threaded into the stud of the wall, said tool attachment having a shaft, a sleeve attached to said shaft and being adapted to receive said screed support members therein, said shaft having an enlarged end portion which is disposed in said sleeve, said enlarged end portion having a slot therein and a pointed node disposed in said slot, said head portions of said screed support members being removably receiving in said slot, said sleeve being removably received in said fourth bores of said elongate member, said tool attachment member further including an annular flange being disposed about said sleeve to limit extension of said sleeve in said fourth bores, said annular flange being contactable with said elongate member.

10. A screed system for walls as described in claim 1, wherein said squaring level assembly includes a laser assembly having a bracket member being adapted to be mounted in a corner of two adjoining walls, and also having a plate-like leveling member being adjustably mounted upon said bracket member and having a hole disposed therethrough, and further having a laser support assembly being fastenably mounted upon said plate-like leveling member, and also having laser members being removably disposed in said laser support assembly and through said hole of said plate-like leveling member, and further having elongate threaded members being attached to a top and a bottom of said plate-like leveling member, and also having fasteners being threaded upon said elongate threaded members, and further having spring members mounted about said bottom elongate threaded members and being biasedly disposed between said bracket member and said plate-like leveling member, and also having a level gauge disposed upon said top of said plate-like leveling member.

11. A screed system for walls as described in claim 10, wherein each of said laser members includes a cylindrical housing having an opening through a wall thereof and also having a slot diametrically opposed to said opening and being disposed through said wall, and further includes a laser light-emitting member being disposed in said cylindrical housing and being adapted to shine a beam of light through said opening and through said hole in said sight member, and also includes an annular stop member being fastenably and movably mounted about said cylindrical housing to adjustably set said laser member in said laser support assembly.

12. A screed system for walls as described in claim 10, wherein said laser support assembly includes a block-like member having a top, a bottom, and sides, and also having bores extending through said top, said bottom, and said sides, said bores being adapted to receive said laser members and to receive said top elongate threaded member of said plate-like leveling member.

13. A screed system for walls as described in claim 10, wherein said laser support assembly includes a pair of disc-shaped members being rotatably mounted upon said plate-like leveling member and being adjustable independently of one another, each of said disc-shaped members having a top, a bottom, and a side, and also having bores extending through said top, said bottom and said side, said bores being adapted to receive said laser members and to receive said top elongate threaded member of said plate-like leveling member, each of said disc-shaped members having degree markings displayed upon said wall.

14. A screed system for walls comprising:

a mounting bracket being adapted to removably mount to a wall, said mounting bracket including a plate-like member being adapted to be fastened to a stud in the wall, and also including leveling tool support members being spaced apart and being securely attached to and extending outwardly from said mounting bracket, and further including spring support members being securely attached to and extending outwardly from said mounting bracket;

a leveling assembly being movably mounted to said mounting bracket and including a leveling tool, said leveling tool including an elongate member having a definite thickness and also having a front and a back and further having a plurality of bores extending through said elongate member, said bores including first bores which are spaced apart and which extend from said front through said back of said elongate member and which are adapted to receive said leveling tool support members therethrough, said bores also including second bores which extend through said elongate member from said front through said back of said elongate member and which are adapted to receive said spring support members therethrough, said bores further including third bores which extend through a side of said elongate member into said first bores, said bores also including fourth bores which extend through said elongate member from said front through said back, said elongate member also including slots being spaced apart and being disposed in said side of said elongate member, said leveling tool further including tubular members being securely disposed in said slots, each of said tubular members including liquid and a bubble for leveling purposes, said leveling assembly also including elongate threaded fasteners being threaded into said third bores and being engagable to said leveling tool support members, and further including springs being mounted about said spring support members and being biasedly disposed between said elongate member and said plate-like member, said spring support members being adjustably fastened to said elongate member with fastening members, said leveling assembly further including a sight member being securely attached to said elongate member and being disposed between said elongate member and said plate-like member of said mounting bracket, said sight member having a hole extending therethrough;

a squaring level assembly including a laser assembly having a bracket member being securely fastened to said back of said elongate member, and also having a plate-like leveling member being adjustably mounted upon said bracket member and having a hole disposed therethrough, and further having a laser support assembly being fastenably mounted upon said plate-like leveling member, and also having laser members being removably disposed in said laser support assembly and through said hole of said plate-like leveling member, and further having elongate threaded members being securely attached to a top and a bottom of said plate-like leveling member, and also having fasteners being threaded upon said elongate threaded members, and further having spring members mounted about said bottom elongate threaded members and being biasedly disposed between said bracket member and said plate-like leveling member, and also having a level gauge disposed upon said top of said plate-like leveling member, each of said laser members including a cylindrical housing having an opening through a wall thereof and also having a slot diametrically opposed to said opening and being disposed through said wall, and further including a laser light-emitting member being disposed in said cylindrical housing and being adapted to shine a beam of light through said opening and through said hole in said sight member, and also including an annular stop member being fastenably and movably mounted about said cylindrical housing to adjustably set said laser member in said laser support assembly;

a plurality of screed support members being adapted to be fastened to and extended outwardly from the stud supporting the wall, each of said screed support members including a threaded shaft portion having a pointed front end, and also including a head portion having a centrally-disposed recessed portion in a back end thereof, said screed support members being adapted to be threaded into the stud of the wall with a plane passing through said back ends of said screed support members; and screed members being securely mounted to said screed support members for determining a depth of plaster being applied to the wall, each of said screed members including a strip of material having a laterally-curved wall and being adapted to fit upon said head portions of said screed support members, said screed members being adapted to determine a depth of plaster and mortar being applied to the wall; and a tool attachment for holding said screed support members when said screed support members are being threaded into the stud of the wall, said tool attachment having a shaft, a sleeve securely attached to said shaft and being adapted to receive said screed support members therein, said shaft having an enlarged end portion which is disposed in said sleeve, said enlarged end portion having a slot therein and a pointed node disposed in said slot, said head portions of said screed support members being removably receiving in said slot, said sleeve being removably received in said fourth bores of said elongate member, said tool attachment member further including an annular flange being disposed about said sleeve to limit extension of said sleeve in said fourth bores, said annular flange being contactable with said elongate member.

15. A screed system for walls as described in claim 14, wherein said laser support assembly includes a block-like member having a top, a bottom, and sides, and also having bores extending through said top, said bottom, and said sides, said bores being adapted to receive said laser members and to receive said top elongate threaded member of said plate-like leveling member.

16. A screed system for walls as described in claim 14, wherein said laser support assembly includes a pair of disc-shaped members being rotatably mounted upon said plate-like leveling member and being adjustable independently of one another, each of said disc-shaped members having a top, a bottom, and a side, and also having bores extending through said top, said bottom and said side, said bores being adapted to receive said laser members and to receive said top elongate threaded member of said plate-like leveling member, each of said disc-shaped members having degree markings displayed upon said wall.

* * * * *